United States Patent [19]

Sauvaget

[11] 4,373,878

[45] Feb. 15, 1983

[54] SYNCHRONIZED HYDRAULIC ROTARY CONVERTER AND DISTRIBUTOR DEVICE

[76] Inventor: Gaston Sauvaget, 6, Allee de l'Oseraie, F-94260 Fresnes, France

[21] Appl. No.: 123,179

[22] Filed: Feb. 21, 1980

[30] Foreign Application Priority Data

Feb. 22, 1979 [FR] France ..... 79 04530

[51] Int. Cl.[3] ..... F03C 2/00

[52] U.S. Cl. ..... 418/23; 418/177; 418/265; 418/268

[58] Field of Search ..... 418/8, 23, 177, 247, 418/251, 265, 25, 26, 175, 268

[56] References Cited

U.S. PATENT DOCUMENTS

| | | | |
|---|---|---|---|
| 1,805,023 | 5/1931 | Springsteen | 418/177 |
| 1,922,639 | 8/1933 | Riesner | 418/247 |
| 2,396,316 | 3/1946 | Chisholm, Jr. | 418/248 |
| 2,714,858 | 8/1955 | Kepka et al. | 418/265 |
| 2,873,683 | 2/1959 | Sherwood | 415/90 |
| 3,008,424 | 11/1961 | Roth | 418/177 |
| 3,139,036 | 6/1964 | McGill | 418/248 |
| 3,241,456 | 3/1966 | Wolfe | 418/251 |
| 3,391,609 | 7/1968 | Schmitz | 418/177 |
| 3,416,457 | 12/1968 | Hare | 418/248 |
| 3,450,004 | 6/1969 | Ernst | 418/177 |
| 3,516,769 | 6/1970 | Korhonen | 418/175 |
| 3,586,466 | 6/1971 | Erickson | 418/268 |
| 3,639,092 | 2/1972 | Sauvaget | 418/175 |
| 3,674,385 | 7/1972 | Rohde et al. | 418/177 |
| 3,924,976 | 12/1975 | Hinckley | 418/8 |

FOREIGN PATENT DOCUMENTS

| | | |
|---|---|---|
| 443618 | 11/1970 | Australia . |
| 435286 | 12/1911 | France . |
| 2340 | of 1912 | United Kingdom . |
| 986172 | 3/1965 | United Kingdom . |

*Primary Examiner*—John J. Vrablik

*Attorney, Agent, or Firm*—Browdy & Neimark

[57] ABSTRACT

Rotary hydraulic device comprising a stator 1, a rotor 2 and closing flanges together forming a tore that can amount to several meters in diameter. The rotor 1 has radial grooves 3 each receiving a valve 4 whose lower face moves on the periphery of the stator which provides swept-volume recesses A, B, C, D limited by a cylindrical part r connected to the periphery of radius R by ramps, the differential valves 4 receiving the thrust of the drive fluid through conduits coming out in the swept volumes.

14 Claims, 18 Drawing Figures

P = HP + BP
1
2
3
4
30
31
33
7a
7b
A
47
32
38
45
46
43
48
39
b
d
c
a
y
34,35,36,37
49
44
L
ℓ
x
f
34
35
36
37

SYNCHRONIZED HYDRAULIC ROTARY CONVERTER AND DISTRIBUTOR DEVICE

BACKGROUND OF THE INVENTION

This invention relates to a synchronized, multiple swept volume distributor convertor hydraulic device to change hydraulic energy into kinetic energy of rotation in the form of a motor, compressor or pump.

Known solutions of making hydraulic motors or pumps do make it possible to obtain both a high number of speed ratios and a good output. Their pressure—power-to-weight—torque ratio nevertheless is very unfavorable. Their life is generally short because of great internal stresses. Their outputs are particularly low at small ratios because they put a considerable volume of inactive fluid in circulation. Uses of hydraulic motors of the known type are now technologically limited in power, the maximum swept volume so far developed being on the order of 20 liters. Actually, devices of this type do not support elastic deformations or organs, ovalizations, size variations, etc., because they produce abnormal stresses causing a very rapid wear and considerable leaks that reduce the power and output. Their good functioning requires very fine surface finishings and very large metal masses to limit leaks.

SUMMARY OF THE INVENTION

The device according to the invention aims at mitigating the above-mentioned drawbacks.

Its main characteristic essentially resides in the fact of making it possible to obtain very great torques at low speeds, it being possible easily to reach the limits of present technology, i.e., on the order of a million m.dN, and this is done with a relatively smaller mass the more the torque increases, therefore, with an increasingly greater power-to-weight ratio.

Another advantage of this device is offering the possibility of self-compensation of the variations in size regardless of orgin (temperature variations, elastic deformations, ovalizations due to very violent couplings or overloads) while producing only very few leaks without causing wear, which makes it possible to avoid the use of large metal masses, because it produces little internal stresses and no cyclic fluctuations. Its overall swept volume can range from a fraction of a liter to hundreds of liters with very numerous speed ratios in both directions of rotation with a remarkable output.

Another considerable advantage lies in the total reliability it assures in case of very great overloads or breakdown of the control organs or receiver by instantly idling. It further makes possible the starting or braking of masses of very great inertia. No useless power is absorbed, which contributes to obtaining an extremely high output in comparison with known devices of comparable power.

These various objects are obtained according to the invention, particularly very great torques and very great power-to-weight ratios, by making the device in the form of a tore of substantially rectangular section made up of a group of concentric rings, namely: a distribution cam or stator in which are made recesses acting as swept volumes delimited by the internal radius R1 of the rotor and by the fluid-tight closing flanges mounted on a bearing. The motor torque is obtained by the average radius of the swept volumes Rm which can amount to several meters, in cooperation with the number of active swept volumes and the number of active valves in these swept volumes. The delivery of the drive fluid is preferably constant, but it is possible, however, to admit a variation on the order of 15% for the change of speeds. Intake of the drive fluid is regulated separately for each swept volume or pair of swept volumes in radial opposition, and the inactive swept volumes are not subjected to a fluid delivery and remain totally free of fluid without absorbing the least power. The valves each have a differential section for double-action regulation by the controlled intake of the fluid under pressure in the active swept volumes. This arrangement make possible self-compensation of variations in size, ovalizations, etc, particularly for large diameters, because the valves are continuously kept in contact under pressure on the active part of the swept volumes. The greater the diameter of the tore, the greater the number, the volume of the swept volumes, and the number of speeds. The speeds are obtained by combining active swept volumes. When all the swept volumes are active there are the greatest torque and slowest speeds; when only the smallest swept volume is active and receives all the drive fluid, there are the smallest torque and the greatest rotation speed of the rotor. Idling is performed by making all the swept volumes inactive.

BRIEF DESCRIPTION OF THE DRAWINGS

Other characteristics and advantages of this invention will be better understood from reading the following description with reference to the accompanying drawings.

DESCRIPTION OF THE PREFERRED EMBODIMENTS

Figure 1:
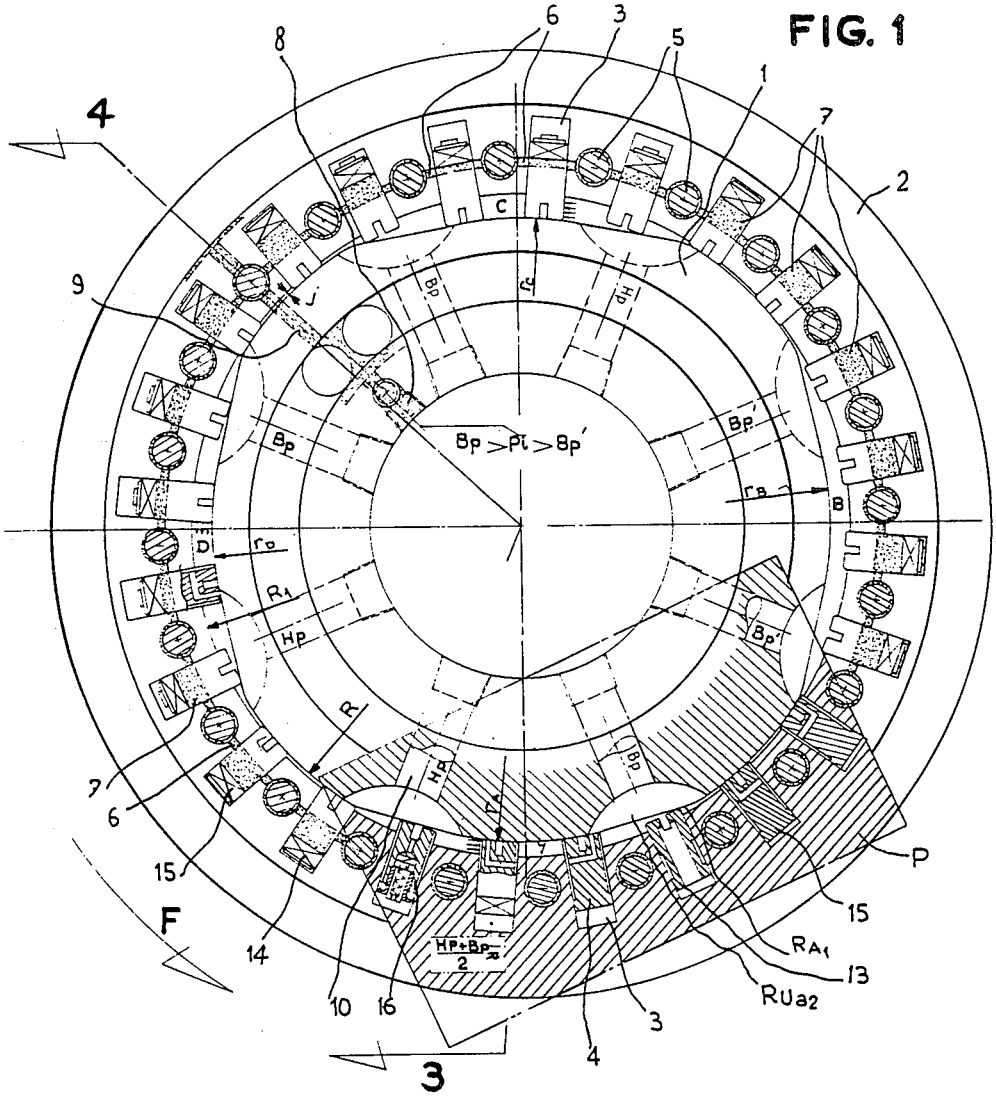
FIG. 1 represents a partial section in elevation of the tore and a part seen with the flange removed.
Figure 2:
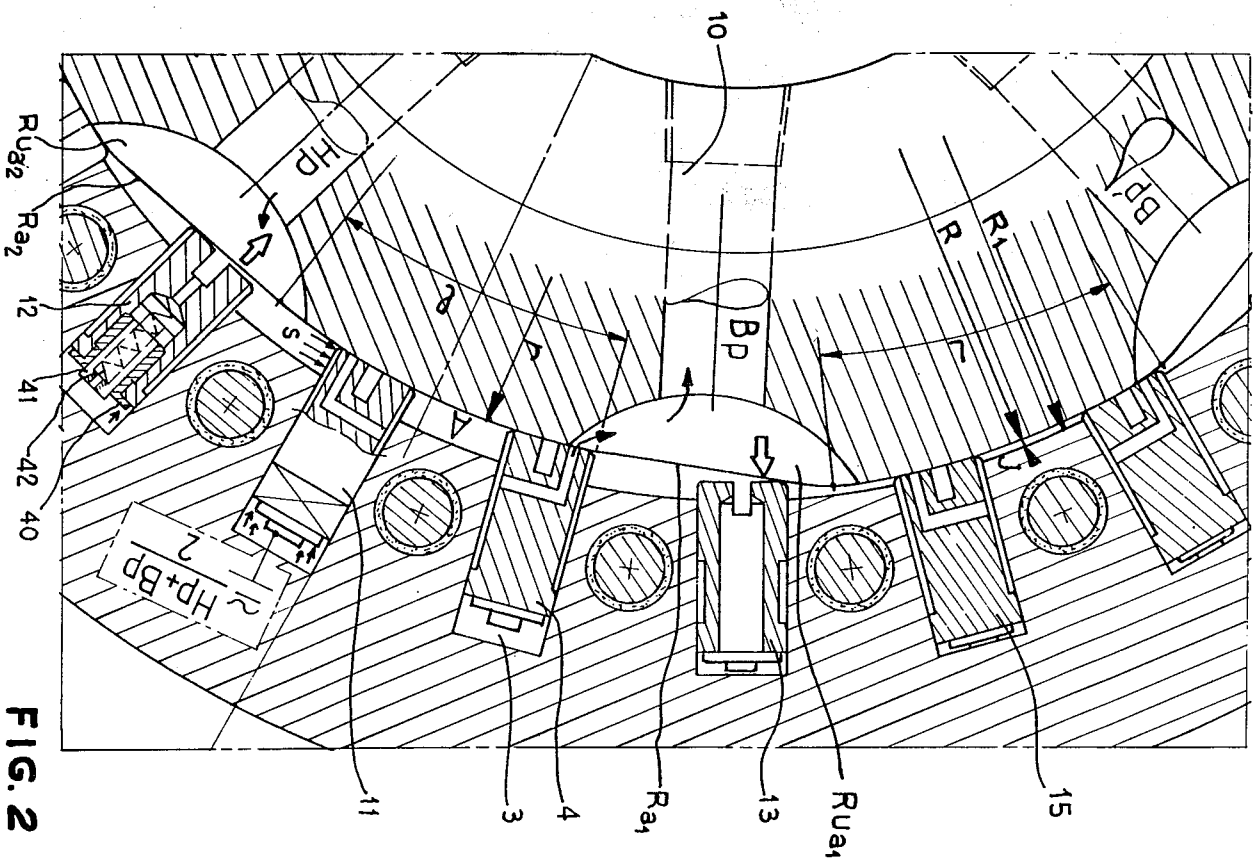
FIG. 2 represents a partial section in enlarged elevation along plane P of FIG. 1.

As shown in elevation in partial section of FIG. 1, the device comprises four equidistant swept volumes A, B. C. D made in stator 1 of outside radius R. The bottom of each of the swept volumes has radius $r_a$, $r_b$, $r_c$, $r_d$. Rotor 2 concentric with stator 1 exhibits a considerable play J between radius R of the stator and inside radius R1 of the rotor. The rotor 2 compries 24 equidistant, radially oriented grooves 3, in which 24 differential valves 4 slide. The closing flanges are assembled by 24 bolts 5. In the zone where the flange has been removed can be seen unsectioned valves and a circular groove 6 supplying differential chambers 7 at pressure Pi prevailing in the case. Pressure Pi can be controlled and regulated by an outside distributor connected to orifice 8 which distributes said pressure by conduit 9. The intake circuits of Pi can be insulated by the swept volume. Swept volume B is represented as inactive, the valves have been brought to the bottom of their housing 3, the other swept volumes A, C, D are active. Each of them is limited by a ramp $R_{a1}$, $R_{a2}$, $R_{b1}$, $R_{b2}$, $R_{c1}$, $R_{c2}$, $R_{d1}$, $R_{d2}$. Each of the ramps comprises a groove Ru; for the swept volume A, these grooves are designated by $Ru_1$, $Ru_2$, etc. The intake and escape conduits 10 of drive fluid come out in these grooves. Depending on the direction of the rotation, these conduits 10 perform the function of fluid intakes or exhausts. Here the direction of rotation is shown by arrow F. Conduits 10 have been designated HP for high pressure and BP for low pressure. In intake swept volume B, all the conduits are under BP. The detail of swept volume A can be seen better from enlargement in section along plane P in FIG. 2. The direcof application of the high pressure on the part of valve 11 in active position in the swept volume in sliding contact on radius $r(r)_2$, designated by arrow S. The thrust on the valve is equal to P bar/cm$^2$ multiplied by the active surface R-r X valve width.

Valve 12 is shown going dowm ramp $R_{a2}$ while another valve 13 goes up ramp $R_{a1}$. A swept volume is delimited by two pre-active valves on both sides of it. In FIG. 1, swept volume A is delimited by valves 14 and 15, valve 16 no longer being fluid-tight on R. The two grooves Ru on each of the swept volumes have a length equal to that of the ramps or preferably a little longer as in FIG. 2. The edge of valve 4 is at the end of cylindrical part r while the edge of groove $Ru_a$ is opposite the pressure exchange conduit of the valve which thereby is made inactive, which allows the valve to go up the ramp under equal pressure, it is the same for valve 12 which descends the ramp. Details of the embodiment of the valve will be described below.

Figure 3:
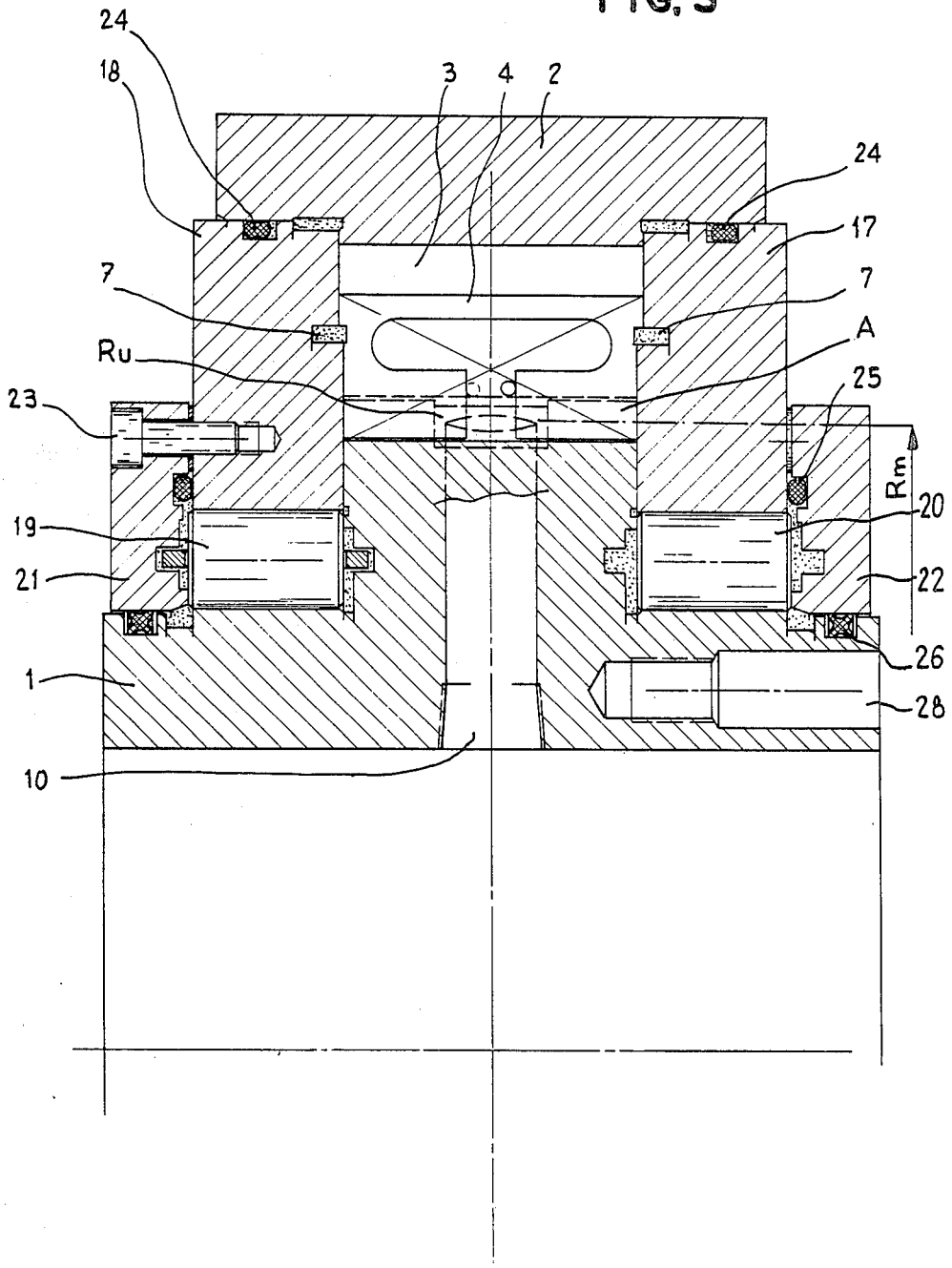
FIG. 3 is a section along arrow 3—3 of FIG. 1.

FIG. 3 shows the section along 3—3 of FIG. 1. The reference numbers of FIG. 1 and FIG. 2 have been used. This view shows the annular structure of the device and the shape of stator 1, rotor 2, closing flanges 17, 18 and roller bearings 19, 20 and their holding flanges 21, 22 fastened by screws 23 on flanges 17, 18. Fluid tightness static joints 24 and rotating joint 25, 26 assure fluid tightness of the unit. Circulation of the fluid at pressure Pi from the case is shown by small-point shading. The valve recall differential chambers 7 can also be seen.

Figure 4:
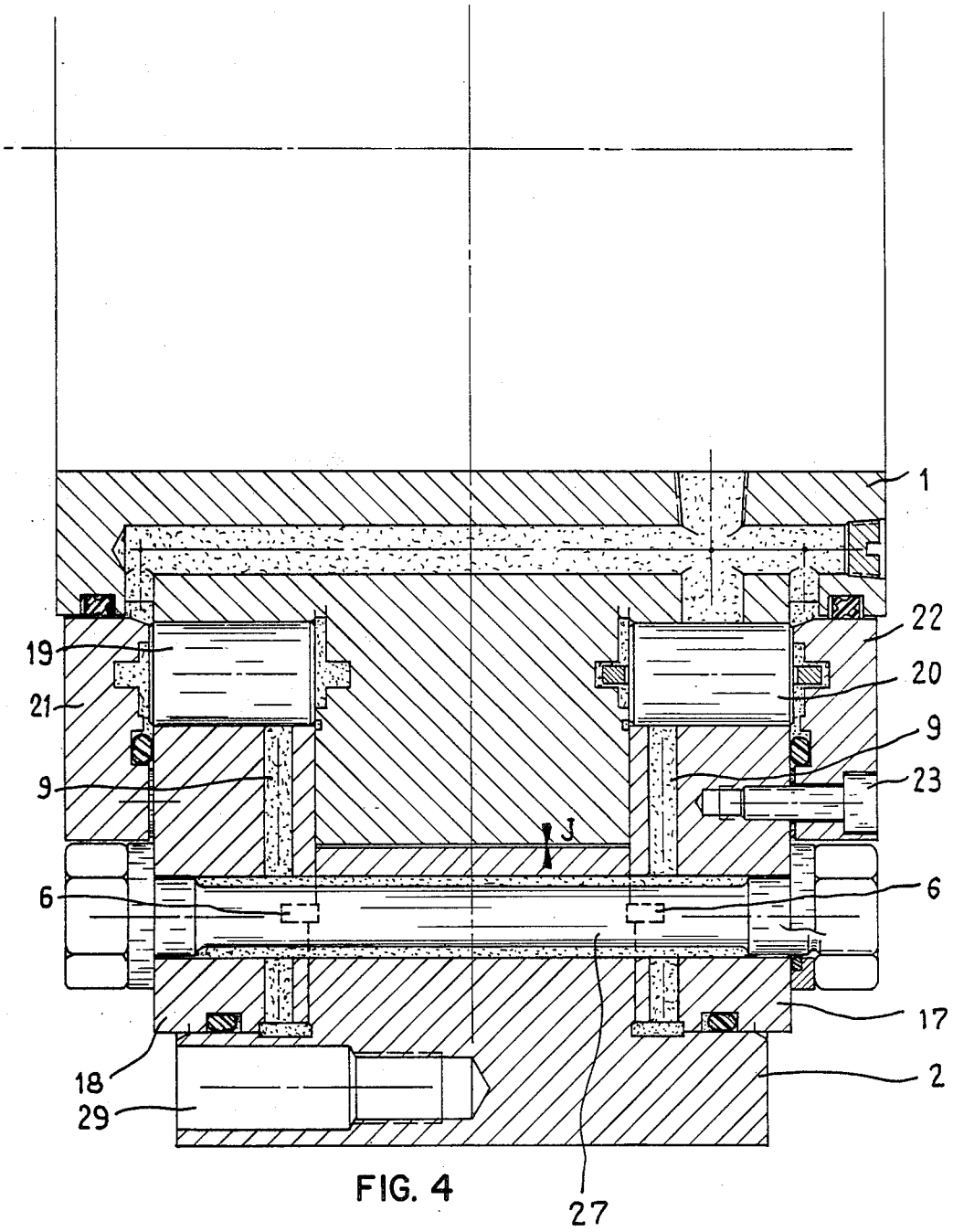
FIG. 4 is a section along arrow 4—4 of FIG. 1, FIG. 5-13 are views showing the differential valve.

FIG. 4 shows a section along 4—4 of FIG. 1. Circulation of the fluid at the case pressure is also shown by a small-point shading and conduits 9 feeding circular groove 6 coming out in valve recall differential chambers 7. This view also shows fastening of flanges 17, 18 on rotor 2 by means of bolts 27. Holes 28 (FIG. 3) and 29 (FIG. 4) comprise a centering and a threading, they serve for fastening to the frame, on the one hand, and to the receving organ, on the other hand.

Figures 5, 6, 7, 8, 9, 10, 11, 12, 13:
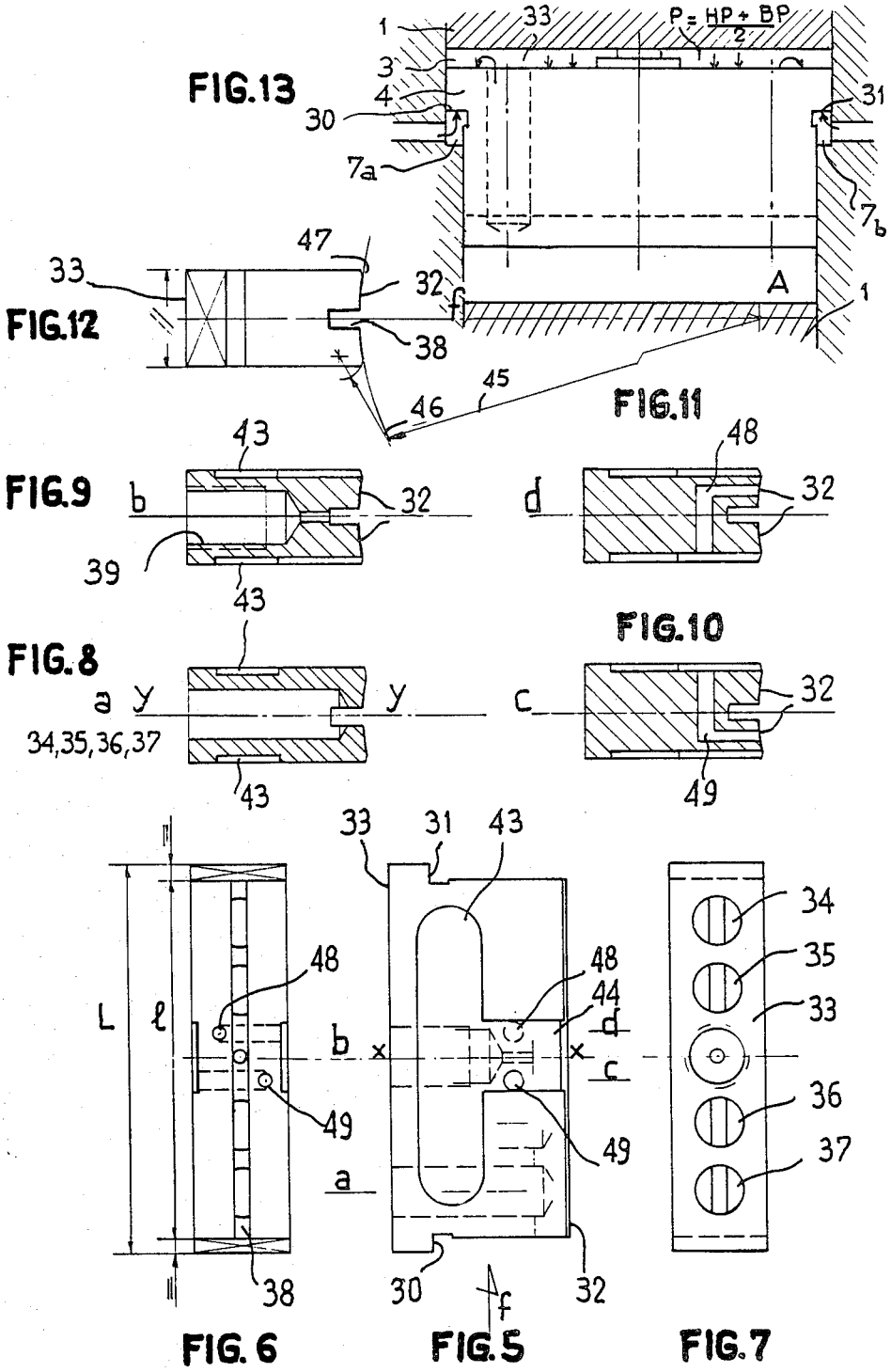

On the 5th sheet is shown the valve of FIGS. 5 to 13. FIG. 5 shows the valve in elevation. It is in the form of a rectangular parallepiped whose differential section is obtained by making a shoulder 30, 31 on the small sides which has the effect of reducing surface 32 of the valve head in relation to the surface 33 of the valve foot on which the drive fluid acts to make the valve slide in its housing, going through said valves by holes 34, 35, 36 37 (FIG. 8) made from surface 33 and coming out in a shallow longitudinal groove 38 located in the axis of symmetry YY of the valve head.

The valve, in its as axis of symmetry XX, comprises a threaded hole 39 (FIG. 9) which receives a threaded pin 40 (valve 12 of FIG. 2) limiting the travel of push rod 41 recalled by spring 42 in the output position.

The function of this push rod is to make the valve pre-active on radius R of the stator in the absence of a deactivating pressure in differential chamber 7 automatically to delimit the active swept volumes at the change over of the valves. The differential recall pressure of the valve in the bottom of its housing should be greater than the recall spring 42 so that output end of rod 41 is almost completely buried in pin 40, which has the effect of preventing the valve from coming in fluid-tight contact on radius R.

Each of the valves is further provided with a shallow flattened portion 43, i.e. an escape, located on each of their large faces parallel in the part of the valve always remaining on the inside of the rotor housing: this escape comes out at 44 on the front face or valve foot. This face 32 is concave along a radius 45 (FIG. 12) which corresponds to the average radius Rm of the swept volume R+r/2. This radius Rm is connected on the large outside faces by a flat, or better, a convex part 46, 47 that is in contact with ramp Ru at the time of descent or ascent of the valves in the swept volumes.

The valves are further provided with pressure exchange conduits 48, 49 (FIGS. 10, 11) each connecting one of the portions of the head 32 with escape 44 located on the opposite large face. Flattening of the valves by means of escape 43, 44 is intended to give greater machining tolerance to the valves housing groove and avoid swinging of the valve under the thrust of the drive fluid. Movement of the valve into its seat is achieved under the action of the drive fluid that penetrates into escape 43 by groove 44 and exert a thrust equal to surface 43 multiplied by pressure HP in bars. For a surface of 10 cm$^2$ and a pressure of 250 bars, the thrust is 2,500 kg. Surface 43 is always greater than that of the swept volume, which makes the movement of the valve into its seat very effective and the valve does not move when it is in fluid-tight contact with radius r of the bottom of the swept volume.

This arrangement contributes considerably to the output because there is friction when the valves are active, they move on a thin film of oil.

FIG. 13 shows the double-action operating diagram of the differential valves. They are sent back to the bottom of their housing 3 when pressure Pi inside the case is modified by an outside drive, for example, a hydraulic distributor not shown, to be made greater than the lower pressure (BP) and the force of the recall spring of the push rod. Pressure Pi acts on shoulder 30, 31 of the valves. When case pressure Pi is normal, the high pressure (HP) acts on face 33 of the valve by an average pressure HP+BP/2 which forces the valve to leave its housing and come in contact radii r and R. Control of the variation can be specific to each swept volume or not. It can be adjusted to define precisely the pressure of contact sliding with the stator on radius R and r.

Figure 14:
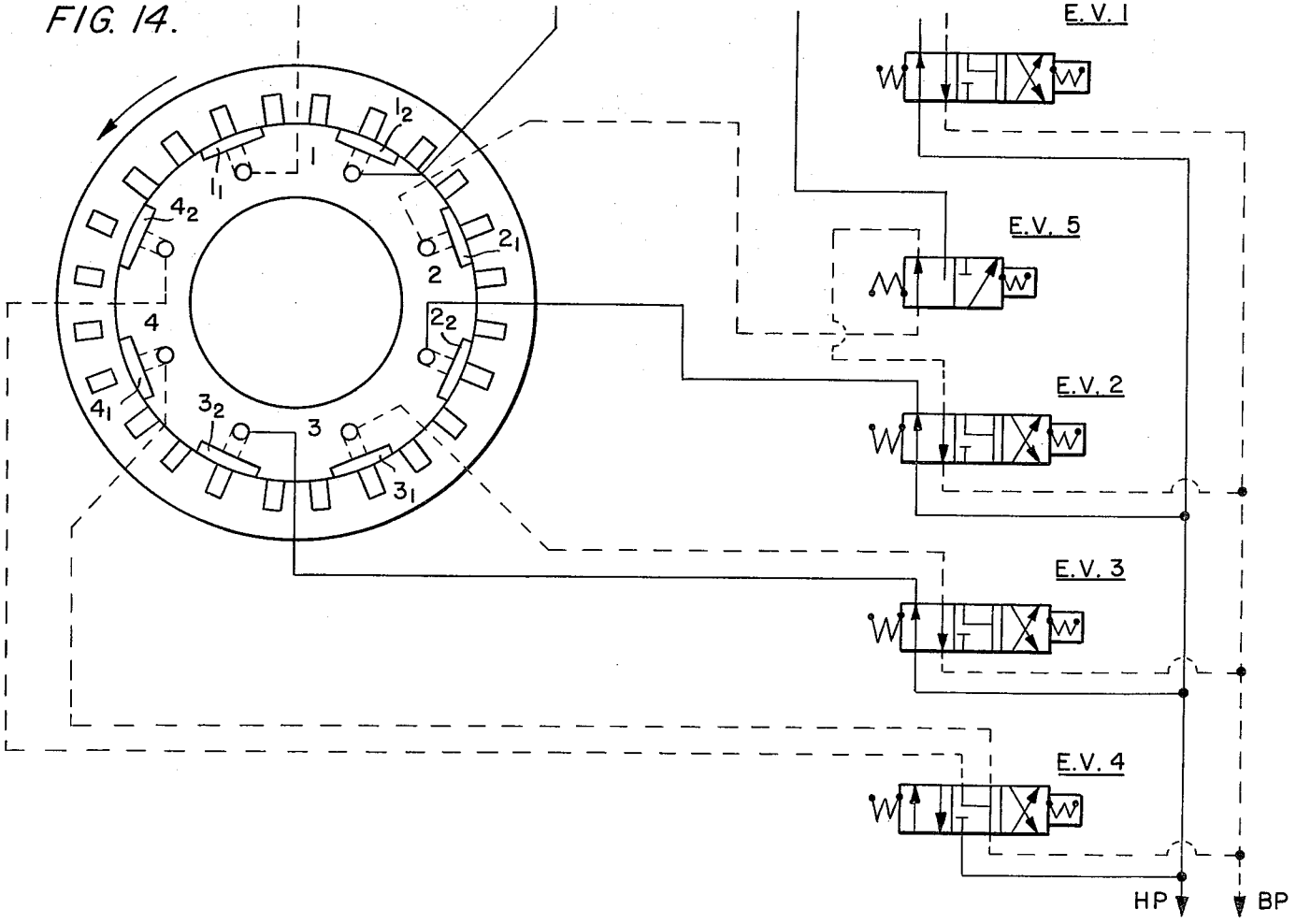
FIG. 14 is a schematic showing of part of the manner of operation of the invention.

FIG. 14 shows, schematically, an engine with four cylinder charges, and suitable means for controlling the intake of the drive fluid for each swept volume and which, in turn, also constitute means to allow for changes in speed and means for making the volume inactive by selective delivery. The inactivation of the valves is accomplished by means such as an electric positioner set, which permits one to feed fluid under high pressure to the displacement cylinders. The cylinder charges 1 and 3 are motorized and are guided by electric positioners EV1 and EV3. The cylinder charge 2, for example, is shown equipped to function as a compressor due to positioners EV2 and EV5. The cylinder charge 4 is put into free wheeling by EV4 simply by the stopping of the motor fluid HP. There are as many electric positioners as there are cylinder charges, and each cylinder charge is normally guided by its electric positioner in one way or the other depending upon the introduction side of the HP. As shown in this schematic diagram, the left position of each electric gate valve shows the engine function or running position, and the right position is illustrative of a compressor function of the invention apparatus. Other means for accomplishing the same functions will present themselves to those skilled in these arts.

The depth of swept volumes R-r is preferably different, particularly when they are three and preferably case of multiples of 2 or 3, of equal depth by diametrically opposite pairs, each pair being able to be different or not in depth from the others. Cylindrical parts R of the stator of developed length 1 and R of developed length L should be of equal length, of such a value that they make it possible to each to receive at least two valves.

The various speed rations can be obtained by a Renard series, by successively combining swept volumes of different or equal volume whose volume is calculated as a function of this progression. Starting at maximum torque is calculated as a function of this progression. Starting at maximum torque can be obtained at very slow speed by throttling the fluid in the feed distribution.

FIGS. 15 through 18 show the versatility of the invention in supplying combinations of charges to obtain a very large range of speeds, even higher than the number of cylinder charges. These figures are based on each cylinder charge or each pair of cylinder charges having a different volume.

Figure 15:
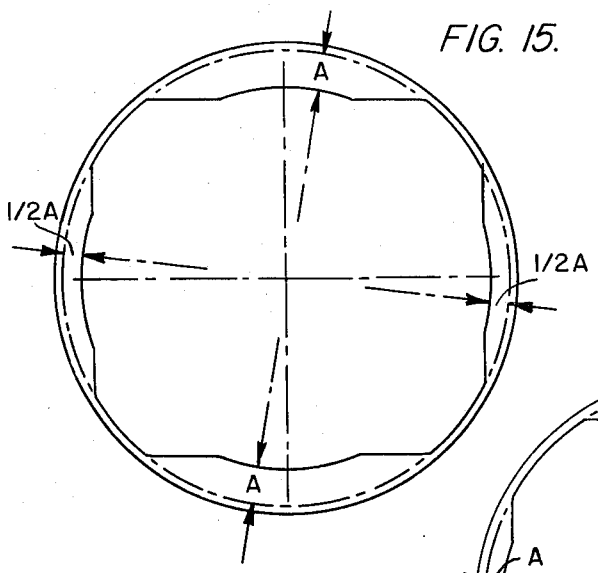
FIGS. 15, 16, 17 and 18 are schematic diagrams showing some of the versatility of the invention.
Figure 16:
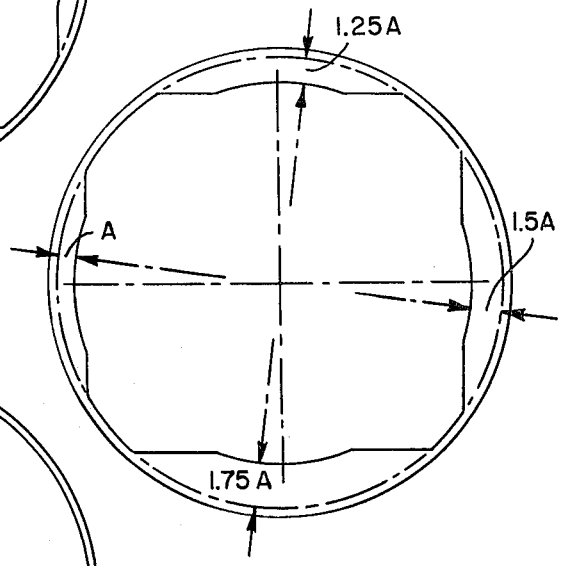
Figure 17:
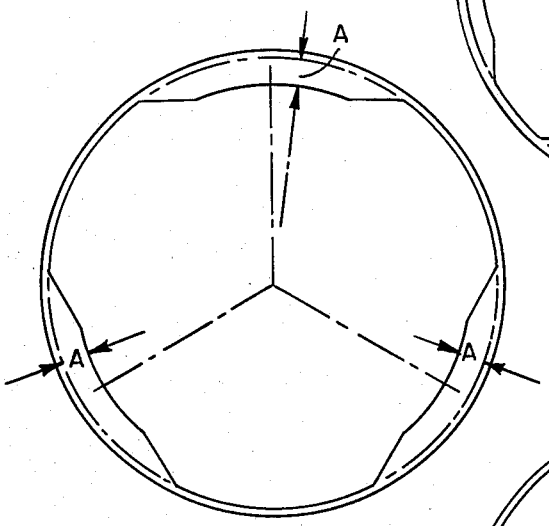
Figure 18:
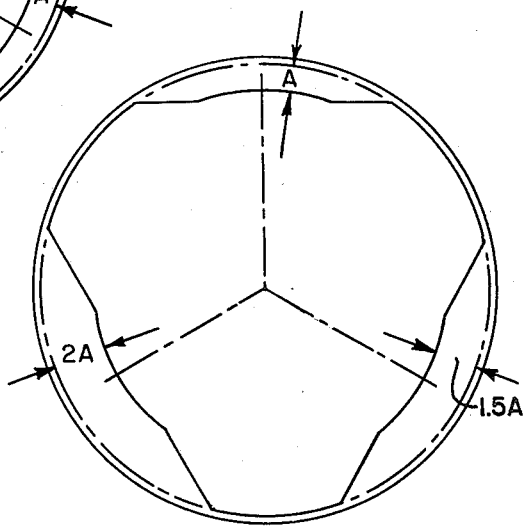

FIGS. 15 and 16 show even numbers of cylinder charges, and FIGS. 17 and 18 show odd numbers; 4 and 3 being used as respective examples.

In FIG. 15 the opposing cylinders, on the sides in FIG. 15, each have a volume of one-half A, where A is a unit volume, a liter, for example. The opposing pair, the upper and lower, have a volume of A, one full liter each, for example. In FIG. 16, the respective cylinder charges are, as indicated in the drawing starting from the left side, A, 1.25A, 1.5A, and 1.75A.

In FIGS. 17, 18, the three volumes in FIG. 17 are all equal, and this figure should be compared to FIG. 18 where the volumes are different, A, 1.25A, and 2.0A, in the example shown.

The number of cylinder charges can be increased with a corresponding increase in the overall diameter and developed length of the rotor, and considering the power and speeds desired, all as will be dictated by a specific environment and as will be well understood by those skilled in these arts.

Thus, using the cylinder charges of different volumes, and combining them in the manner illustrated and described above, various different ratios can be achieved. For example, referring to FIG. 16, if all four cylinder charges are used, then the total capacity is A plus 1.25A plus 1.5A plus 1.75A or 4.5A. By using only the two side cylinders, for example, a volume and corresponding speed of 2.5A only can be used. By using only the upper and the right hand cylinder charge, a total volume and corresponding speed of 2.75A can be achieved. Many other combinations are, of course, possible by using different combinations of the different cylinder charges.

At least one of the swept volumes can be used as a pump, compressor, distributor to drive control accessory functions or one or more swept volume of a second motor operating parallel or in series with the first.

The invention applies to all cases of coupling, uncoupling, distribution or conversion of power, speeds, torques for small, medium, large and very large powers.

I claim:

1. In a hydraulic converter distributor device, intended to transform a hydraulic energy into kinetic energy or rotation or vice versa, having a hub stator, said hub stator having an inside diameter of at least 0.5 meter, a rotor in which are radially oriented equidistant grooves, a respective valve received in each of the grooves each of said valve having a lower face which moves on a periphery of the stator and which includes recesses defining swept volumes, conduits coming out in the swept volumes, the valves receiving thrust of drive fluid regulated externally, assuring driving in rotation of the rotor by successively moving in the swept volumes of the stator, and two side flanges mounted on bearings and solid with the rotor closing the device in a fluid-tight manner, the improvement wherein said rotor, said stator and said flanges are of annular shape and constitute a tore of substantially rectangular section of which an average radius of said swept volumes amounts to up to about several meters and whose number is a function of length of the average circumference at magnitude of said average radius total volume of said swept volumes amounting to up to about several hundred liters, and including means for delivering constant drive fluid while allowing for changes of speeds, a 15% variation more or less, means for controlling separately intake of the drive fluid for each of said swept volumes or diametrically opposite pairs of said swept volumes, and means for making at least one of said swept volumes inactive by selective fluid delivery, and wherein said valves are double-acting to both control putting them into action directly by only the pressure of fluid in the active said swept volumes or else recall them to respective bottoms of their housing by a differential pressure (Pi) or adjustable case pressure as a function of needs and putting into operation by an external distributor, idling of said rotor being obtained by making all said swept volumes inactive, and said swept volumes having different depths to thereby define a ratio of the decreasing volume of swept volumes to thereby increase the number of speed ratios available.

2. An improved device according to claim 1, wherein said valves are controllable double-action valves having substantially rectangular parallelepiped shape whose two small sides exhibit a shoulder intended to reduce the surface of contact with the bottom of a respective said swept volume in relation to an opposite surface on which control face of the drive fluid acts, said surface of contact being divided longitudinally into two equal parts by a shallow groove, wherein two contact surface portions exhibit a concave profile whose radius is between radii (R and r) of said swept volumes, wherein these two concave surfaces are connected to corresponding parallel outside large faces by a flat to convex profile, and wherein holes go through a respective said valve to connect the concave contact surface with the opposite surface coming out in the longitudinal groove.

3. An improved device according to claim 1 or claim 2, wherein said swept volumes are defined by an inside diameter of rotor (R1) on both sides of said two flanges and recesses in said stator, wherein said recesses exhibit a cylindrical portion limited on each side by a ramp identical in shape and length connected to a cylindrical periphery (R), characterized in that cylindrical parts (r) of the stator are of equal length and value to allow each simultaneously to receive at least two valves, in the inside radius (R1) of the rotor and the radius (R) of the stator, placed concentrically, exhibit a considerable play, in that the respective swept volume is dynamically limited at each of its ends by a valve made pre-active in fluid-tight contact on radii (R,r), in that the connecting ramps of radii (R and r) of each swept volume each comprise a distribution groove of a length equal to slightly greater than the length of the ramps, in that a conduit for passage of the drive fluid comes out in each distribution groove (Ru).

4. An improved device according to claim 1, wherein said valves include at least a pair of independent pressure exchange conduits, one connecting the concave surface of the large face and the other, symmetrically, the second concave surface with the other large face.

5. An improved device according to claim 2, wherein said valves are made active by putting them in fluid-tight contact, a cylindrical portion (r,R), by means of a pressure (HP+BP/2) acting on the face opposite the concave face because of the difference in the two surfaces, fluid tightness of the contact becomes effective when said concave surface and in particular the pressure exchange conduit is in contact with cylindrical parts (R,r) after having a left drive fluid intake groove (Ru) and is flattened in its housing, and wherein deactivation of the respective valve is performed as soon as a pressure exchange conduit is put in communication with said intake groove (Ru) of the other ramp, i.e. at low pressure, and wherein Hp and Bp are a high pressure and a low pressure, respectively.

6. An improved device according to claim 1, wherein said swept volumes can be made inactive by a variation of pressure (Pi) inside controlled by an outside distributor acting on a surface of differential shoulders of said valves by differential chambers defined by said rotor and said stator and brought to pressure (Pi) by conduits going through said flanges and connected to said distributor to make said valves go back to the bottom of their housing, the pressure (Pi) being identical in the case unit, wherein the variations of pressure (Pi) can be specific to each said swept volume, and wherein pressure (Pi) can be adjusted to define precisely sliding contact pressure of the valves on radii (r,R).

7. An improved device according to claim 1, wherein different ratios of speeds of rotation of said rotor and corresponding torque are obtained by means of a drive fluid distribution unit of known type, delivering at a given rate, for slowest speed and highest couple, in all the swept volumes which are all then active and progressively, by feeding the swept volumes less and less to increase the speed while reducing the torque, until delivering for the highest speed and least torque, all the drive fluid in the smallest said swept volumes.

8. An improved device according to claim 1, wherein at least one of the swept volumes is used to control or regulate the accessory functions or at least a swept volume or a second device operating in series or parallel with the first.

9. An improved device according to claim 1, wherein the depth of the swept volumes (R-r) is increased from one swept volume to the other in a constant ratio from the smallest one to the largest one, for an odd number of swept volumes.

10. An improved device according to claim 1, wherein the depth of the swept volumes (R-r) is increased in a constant ratio by a pair of swept volumes, each swept volume in opposition having the same depth, the device comprising at least two pairs of swept volumes.

11. An improved device according to claim 1, wherein the pressure Pi is always higher than the low pressure Bp.

12. An improved device according to claim 1, wherein there are at least three swept volumes of different depths (R-r).

13. In a hydraulic converter distributor device, intended to transform a hydraulic energy into kinetic energy or rotation or vice versa, having a hub stator, a rotor in which are radially oriented equidistant grooves, a respective valve received in each of the grooves, each said valve having a concave surface which moves on a periphery of the stator and which includes recesses defining swept volumes, each said valve comprising a push rod with limited travel with spring recall coming out of a face located on a side opposite said concave surface, conduits coming out in the swept volumes, the valves receiving thrust of drive fluid regulated externally, assuring driving in rotation of the rotor by successively moving in the swept volumes of the stator, and two side flanges mounted on bearings and solid with the rotor closing the device in a fluid-tight manner, the improvement wherein said rotor, said stator and said flanges are of annular shape and constitute a tore of substantially rectangular section of which an average radius of said swept volumes amounts to up to about several meters and whose number is a function of length of the average circumference at magnitude of said average radius, total volume of said swept volumes amounting to up to about several hundred liters, and including means for delivering constant drive fluid while allowing for changes of speeds, a 15% variation more or less, means for controlling separately intake of the drive fluid for each of said swept volumes or diametrically opposite pairs of said swept volumes, and means for making at least one of said swept volumes inactive by selective fluid delivery, and wherein said valves are double-acting to control putting them into action directly by pressure of fluid in the active said swept volumes or else recall them to respective bottom of their housing by a differential pressure (Pi) or adjustable case pressure as a function of needs and putting into operation by an external distributor, idling of said rotor being obtained by making all said swept volumes inactive.

14. An improved device according to claim 13, wherein two large parallel faces of said valves are each provided with a shallow escape of which one comes out on a side of the concave surface, the principal part of the escape is in a zone of the valve always remaining engaged in the rotor housing to cause the valve to seat on the housing face opposite the pressure of the drive fluid.

* * * * *